United States Patent [19]

Dostall et al.

[11] Patent Number: 4,998,947

[45] Date of Patent: Mar. 12, 1991

[54] CORNER CAP STRUCTURE AND METHOD

[75] Inventors: Gregory W. Dostall, Mt. Laurel; Thomas J. Saloom, Plainsboro, both of N.J.

[73] Assignee: Alcan Aluminum Corporation, Cleveland, Ohio

[21] Appl. No.: 436,214

[22] Filed: Nov. 14, 1989

[51] Int. Cl.[5] ..... E04H 12/00

[52] U.S. Cl. ..... 52/300; 52/244; 52/254; 52/288

[58] Field of Search ..... 52/549, 254, 244, 288, 52/716, 301, 58, 300

[56] References Cited

U.S. PATENT DOCUMENTS

| | | | |
|---|---|---|---|
| 364,044 | 5/1887 | Sagendorpf . | |
| 443,322 | 12/1890 | Kinnear . | |
| 1,315,260 | 9/1919 | Tischler . | |
| 1,664,463 | 4/1928 | Muryn . | |
| 3,287,041 | 11/1966 | Cohen | 52/244 X |
| 3,353,854 | 11/1967 | Hansen | 52/288 X |
| 3,717,968 | 2/1973 | Olsen et al. | 52/288 |
| 3,942,295 | 3/1976 | Schacht . | |
| 4,186,531 | 2/1980 | Okolischan | 52/58 X |
| 4,539,784 | 9/1985 | Allen | 52/217 |
| 4,642,957 | 2/1987 | Edwards | 52/288 X |

*Primary Examiner*—David A. Scherbel
*Assistant Examiner*—Linda J. Watson
*Attorney, Agent, or Firm*—Calfee, Halter & Griswold

[57] ABSTRACT

A corner cap which is designed to be formed into a selected configuration, and then attached to the corner post of a building. The corner cap is designed so that its configuration is adjustable to enable the corner cap to be attached to corner posts with configurations which can vary over a predetermined range. In use, the corner cap is adjusted, on site, to a selected configuration which corresponds to the configuration of a corner post. The corner cap is then fixed in the selected configuration, and attached to the corner post to close the end of the corner post.

20 Claims, 5 Drawing Sheets

CORNER CAP STRUCTURE AND METHOD

TECHNICAL FIELD

The present invention relates to a corner cap for attachment to the corner post of a building. It relates particularly to a corner cap whose configuration is adjustable to enable the corner cap to be attached to corner posts with configurations which can vary over a predetermined range. Further, the present invention relates to a method of forming a corner cap with a configuration which is adjustable to correspond to the configuration of a corner post, and attaching the corner cap to the corner post.

BACKGROUND

In buildings with exterior siding panels, it is common to provide corner posts extending vertically along the corners of the building. Typically, the siding panels would be spaced slightly above ground level, and the corner posts would extend from just below the siding panels to just below the eave of the building. The corner posts provide a trim external appearance at the corners of the building. Further, the corner posts define exterior guides which help locate the siding panels, and maintain the siding members in proper orientation on the building.

A typical corner post is a generally channel-like structure which is attached to the frame of the building and defines an interior channel extending along the building. After securing the corner post to a building, it is desirable to close the ends of the corner post to seal the interior channel against ingress of animals (e.g., insects) and/or the outside environment, and to provide an aesthetically pleasing appearance at the ends of the corner post. One common technique for closing an end of a corner post is to slit the part of the corner post which extends beyond the siding panels into segments, and to bend the segments inward to close the end of the interior channel of the corner post.

The present invention relates to a corner cap for attachment to the end of a corner post, to close the interior channel formed in the corner post. However, in designing the corner cap, one problem which had to be addressed was the fact that corner posts of different buildings do not always have the same corner angles. This can be due to the geometrical form of the building and its corners. It can also be due to warpage of corner posts due to environmental factors such as heat, cold, rain, ice, etc.

In any event, variations in the corner angles of corner posts presents a problem in designing a corner cap structure for attachment to the corner posts. If a corner cap is manufactured with a fixed corner angle, it is not possible to adjust that corner angle without deforming the corner cap. However, deforming the corner cap can distort the appearance of the corner cap, and can result in an imprecise fit of the corner cap with the corner post. It is possible to manufacture corner caps with different corner angles, and to try and select a particular corner cap to fit a particular corner post configuration. However, manufacturing corner caps with different corner angles is expensive, and might require having an excess of corner caps on site to try and select the corner cap most likely to fit a particular corner post configuration. Moreover, it might still be necessary to deform a corner cap in order to attach the corner cap to a corner post whose configuration has changed due to environmental factors such as heat, cold, rain, ice, etc.

SUMMARY OF THE PRESENT INVENTION

The present invention provides a single corner cap structure whose configuration is adjustable, and which can be formed, on site, into a cover for corner posts with different configurations. More specifically, the present invention provides a single corner cap structure whose corner angle can be adjusted, on site, to enable the corner cap to match the configuration of a corner post which is being closed by the corner cap.

Further, the present invention provides a method of selectively forming a corner cap, on site, with a selected corner angle, to match the configuration of a corner post, and attaching the corner cap to the corner post to close the end of the corner post.

According to one preferred embodiment, the corner cap comprises a pair of substantially planar base portions which are integrally connected at a corner. The base portions can pivot about the corner over a predetermined angular range, in order to adjust the corner angle of the corner cap. Specifically, the base portions can pivot from an angular orientation in which they are substantially co-planar, to an angular orientation in which they are overlapped by a predetermined amount. Over that angular range, the corner angle formed by the base members can vary from a maximum value (i.e., when the base members are co-planar) to a minimum value (i.e., when the base members are overlapped by the predetermined amount). The base members can be adjusted to form a corner angle at any value between the maximum and minimum values. Over that range of adjustment of the corner angle, the base portions can form a substantially complete cover for a corner post having a corresponding corner angle.

According to another preferred embodiment, the planar base portions are disposed in discrete, parallel planes. The planar base portions can pivot between two principal angular orientations and still define a substantially complete cover for a corner post. In one principal angular orientation, the base members remain in discrete, parallel planes and are not overlapped, but are oriented relative to each other to form a substantially complete cover for the end of a corner post. In the other principal angular orientation, the base members are overlapped by a predetermined amount, and form a substantially complete cover for the end of a corner post. As they pivot between the two principal angular orientations, the corner angle formed by the base members can vary from a maximum value (i.e. when the base members are non-overlapping) to a minimum value (i.e. when the base members are overlapped by the predetermined amount). When the corner angle is at either its minimum or maximum value, the base members form a substantially complete cover for the end of a corner post. The base members can be adjusted to form a corner angle at any value between the maximum and minimum values to form a substantially complete cover for the end of a corner post having a corresponding corner angle.

Further, according to either preferred embodiment, the corner cap includes wall portions integrally formed with the base portions. The wall portions extend substantially perpendicular to the planar base portions. When the base portions are formed into a selected corner angle, the wall portions form a short channel which will fit against the inside of the interior channel of a corner post with a corresponding corner angle. The short channel formed by the wall portions helps properly locate and connect the corner cap with the corner post.

According to the method of the invention, constructing and attaching a corner cap with a corner post comprises the steps of (i) forming the corner cap with integrally connected, adjustable sections, (ii) adjusting the sections to form the corner cap into a configuration having a corner angle selected to match the corner angle of a corner post, (iii) fixing the corner cap in that configuration, and (iv) attaching the corner cap to the corner post. In adjusting the corner cap into a selected configuration, the base portions are brought into a relationship with each other such that the corner cap defines the selected corner angle. The base portions are then fixed together to fix the corner cap in the selected configuration. The corner cap is then assembled with the corner post by inserting and securing the small channel formed by the wall portions in the interior channel in the corner post. The corner cap will then effectively close the interior channel formed in the corner post.

A corner cap according to the invention can be adjusted, on site, to a selected configuration which will form a substantially complete cover for a corner post whose corner angle is within a predetermined configuration. The corner cap can then be fixed in the selected configuration, on site, and attached to the corner post. According to the preferred embodiment, the corner cap can be adjusted to form a corner angle which can be adjusted from about 85° to about 135° and form a substantially complete cover for a corner post.

A corner cap according to the invention can be made of various known building materials such as metal (e.g., aluminum) or vinyl.

The present invention will be further understood with reference to the following detailed description taken with reference to the accompanying drawings.

DETAILED DESCRIPTION OF THE PREFERRED EMBODIMENT

Figure 9:
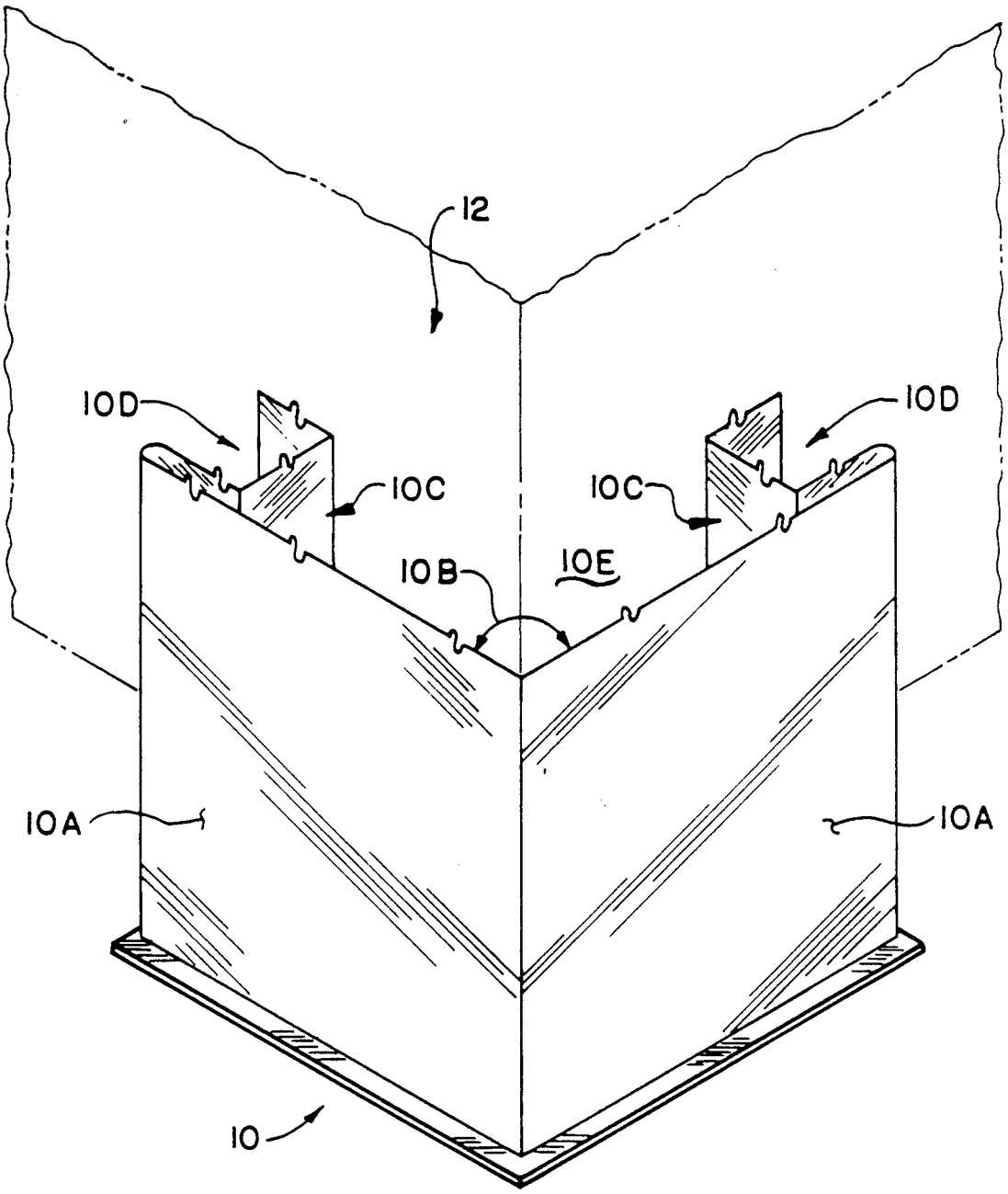
FIG. 9 is a fragmentary, three dimensional illustration of an end of a corner post attached to the frame of a building.

As discussed above, the present invention relates to a corner cap structure for attachment to the end of a corner post, and to a way of forming the corner cap and attaching the corner cap to the corner post. FIG. 9 schematically illustrates a typical configuration of an outside corner post 10 attached to a portion 12 of the frame of a building. Basically, the outside corner post 10 comprises a longitudinally extending, channel-like structure which is attached to the frame portion 12 of the building. The corner post comprises a pair of corner walls 10A forming an exterior corner angle 10B, and a pair of side walls 10C connecting the corner walls with the frame portion 12. The side walls 10C form exterior channels 10D which are designed to receive horizontal siding panels (not shown) in a manner well known to those in the building trades.

Typically, in a building the lower end of the frame portion 12 would be spaced above the ground, and the corner post 10 would extend slightly below the frame portion 12. The top end of the frame portion would be spaced from the eave of the building, and the upper end of the corner post would extend slightly above the frame portion but below the eave of the building.

As illustrated schematically in FIGS. 5–8, the corner post 10 is bolted to the frame portion 12 of the building. The corner post can also be fixed to the frame portion 12 of the building by any other fastening means known in the building trades. The corner post 10 can be made of materials such as aluminum, vinyl, or other materials known in the building trades.

Figure 5:
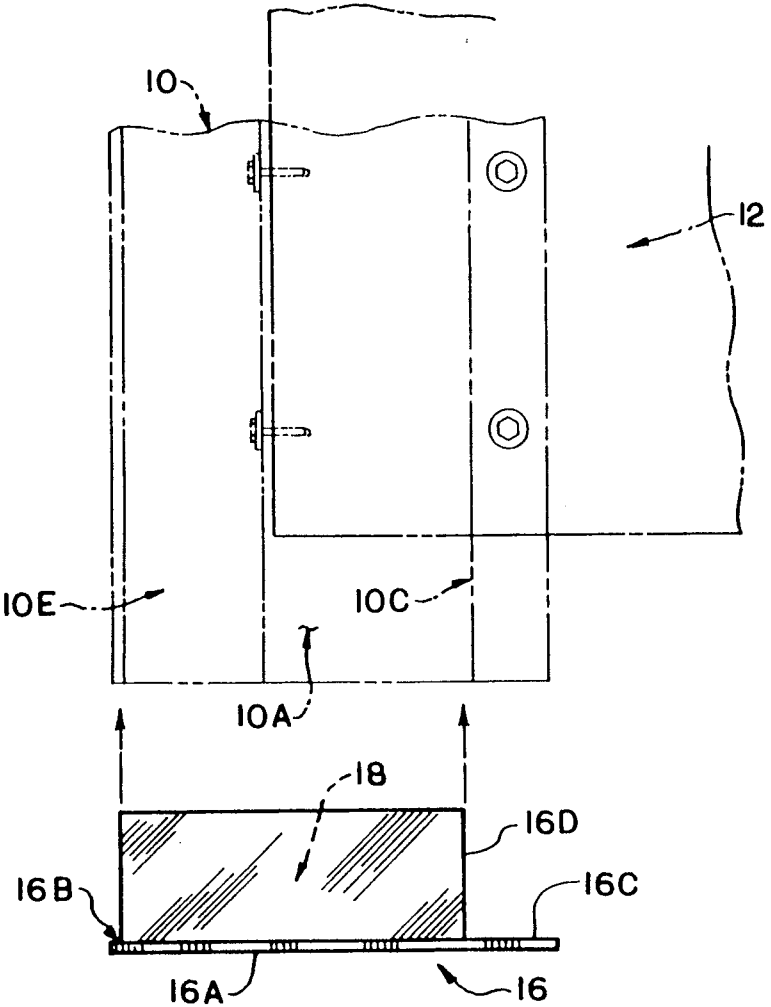
Figure 7:
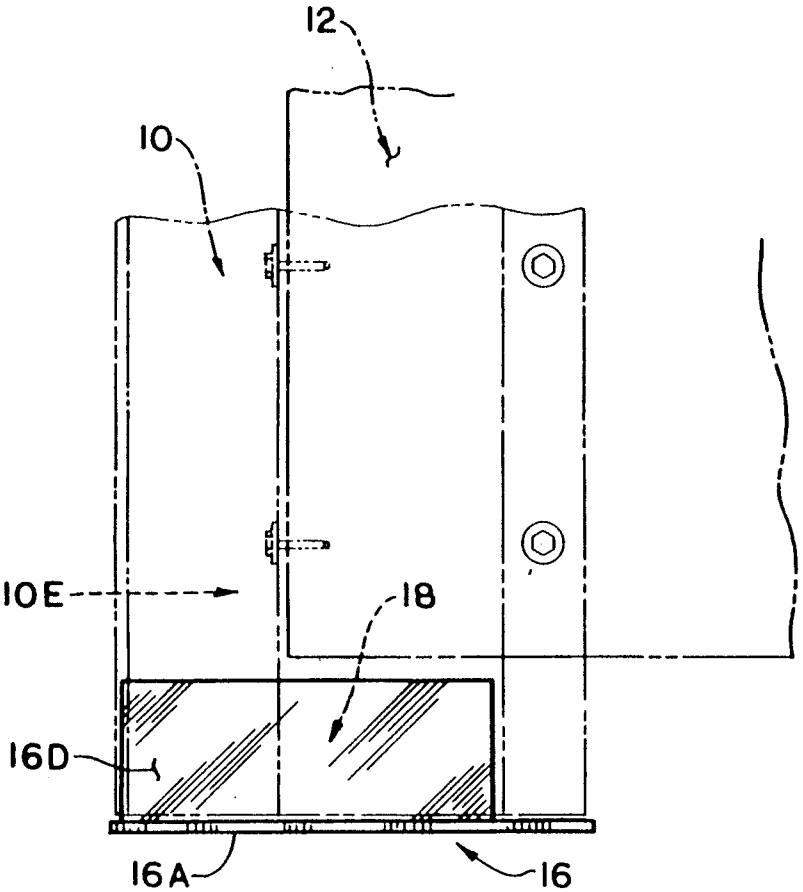

As seen from FIGS. 5, 7 and 9, the corner post 10 is a channel-shaped structure which extends vertically along the frame portion 12 of the building. The corner post 10 defines an interior channel 10E extending along the frame portion 12 of the building, and extending slightly below the frame portion of the building (see FIGS. 5, 7 and 9). The interior channel 10E needs to be closed, to prevent animals (e.g., insects) and/or the elements (i.e., water, ice, etc.) from getting at and attacking the frame of the building.

A corner cap 16, constructed according to the principals of this invention, which closes the end of the corner post, is illustrated in FIGS. 1–8. The corner cap 16 comprises a pair of substantially planar base portions 16A, which are hinged together at a corner 16B which is integrally formed with the base portions. The planar base portions 16A are generally wedge or triangular shaped and can pivot about the corner 16B. Each of the planar base portions includes an integral distal finger portion 16C. Further, each of the base portions 16A has an integral wall portion 16D extending perpendicular to the plane of the base portion (see e.g., FIGS. 1, 3 and 4).

The base portions 16A are adapted to pivot about the corner 16B between two principal configurations. In one principal configuration, illustrated in FIG. 2, the base portions 16A are immediately adjacent to each other, and are co-planar with each other. In another principal configuration illustrated in FIGS. 1, and 5–8, the base portions 16A are overlapped to such an extent that ends of the wall portions 16D are adjacent each other. As will be readily appreciated by those of ordinary skill in the art, the base portions 16A can be pivoted about the corner 16B into overlapped, intermediate configurations anywhere between the principal configurations of FIGS. 1 and 2. Further, as readily seen from FIGS. 1 and 2, in the principal configurations, and in any of the intermediate configurations, the base portions 16A do not have any gaps between them; hence, the base portions 16A will form a substantially complete cover for the end of a corner post.

According to the preferred embodiment, the corner cap 16 is formed of aluminum or vinyl. However, the corner cap can also be formed by any other materials which are conventional in the building trades. Further, the corner cap 16 is an integrally formed structure which can be formed by injection molding, casting or other known techniques for forming aluminum or vinyl structures.

The wedge-shaped base portions 16A and the corner 16B define the corner angle $\phi$ of the corner cap. As the base portions 16A are adjusted between the principal configurations of FIGS. 1 and 2, the corner angle $\phi$ will change, but the base portions will still form a substantially complete cover for a corner post. According to the preferred embodiment, the corner angle $\phi$ can be adjusted between a minimum value of 85° (when the base sections are in the orientation of FIGS. 1, 5–8) and a maximum value 135° (when the base sections are in the orientation of FIG. 2) and still form a complete cover for the end of a corner post.

Figure 2:
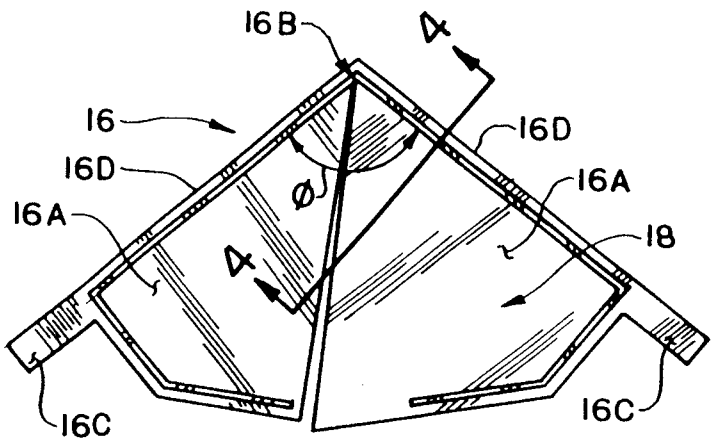
FIG. 2 is a top plan view of the corner cap, showing the components of the corner cap in another selected configuration.
Figure 1:
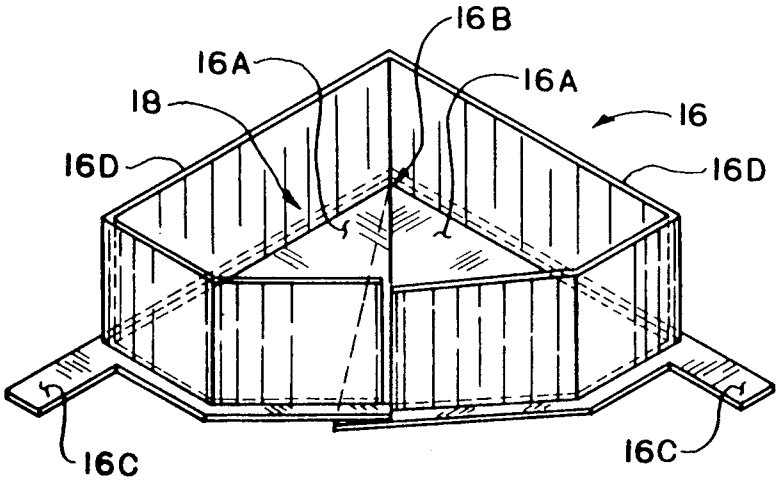
FIG. 1 is a three dimensional, perspective illustration of a corner cap constructed according the principles of the present invention, and illustrating the components of the corner cap in one selected configuration.
Figure 3:
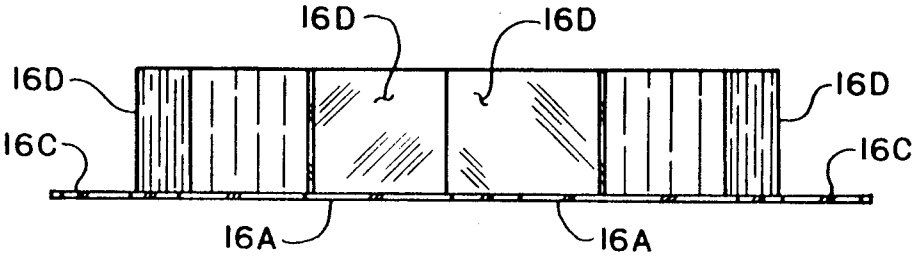
FIG. 3 is a front plan view of the corner cap of FIG. 2, taken from the direction 3—3.
Figure 4:
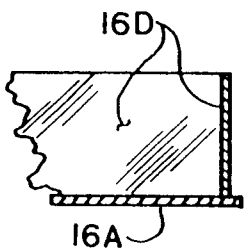
FIG. 4 is a fragmentary, sectional view of the corner cap of FIG. 2, taken from the direction 4—4.

As seen particularly from FIG. 1, when the base portions 16A are in a selected configuration the wall portions 16D define a short channel 18 extending perpendicular to the base portions 16A. The wall portions 16D forming the short channel 18 are designed to fit against parts of the interior channel 10E of a corner post 10 when the corner cap 16 is attached to the corner post. Furthermore, the height of the wall portions 16D is relatively short, so that the depth of the short channel 18 is slightly less than the distance by which the corner post 10 extends beyond the frame of a building (see FIGS. 5 and 7). Thus, when the corner cap 16 is attached to the end of a corner post 10, the short channel 18 formed by the wall portions 16D should extend into the interior channel of the corner post and terminate just below the frame portion 12 of the building (see FIGS. 7, 8).

In assembling the corner cap 16 with a corner post 10, the corner cap 16 is formed, on site, into a configuration with a selected corner angle, and is then fixed in that configuration and attached to the corner post. For example, FIGS. 5–8 schematically illustrate the configuration of a corner post 10 with a corner angle 10B of approximately 85°. That is the smallest corner angle which a corner cap 16 according to the invention is designed to form. The corner cap of FIGS. 1–8 is formed into a configuration with an 85° corner angle by overlapping the base portions 16A until the corner cap 16 has the configuration shown in FIGS. 1, 5–8. In that configuration, the base sections 16A are overlapped to their maximum extent, and define a corner angle of approximately 85°, to match the corner angle 10B of the corner post 10. The base portions 16A are then secured together, preferably by adhesive, in order to secure the base portions 16A in that selected configuration. Thus, the corner cap 16 is formed, on site, into a selected configuration which will match the configuration of the corner post 10.

Figure 6:
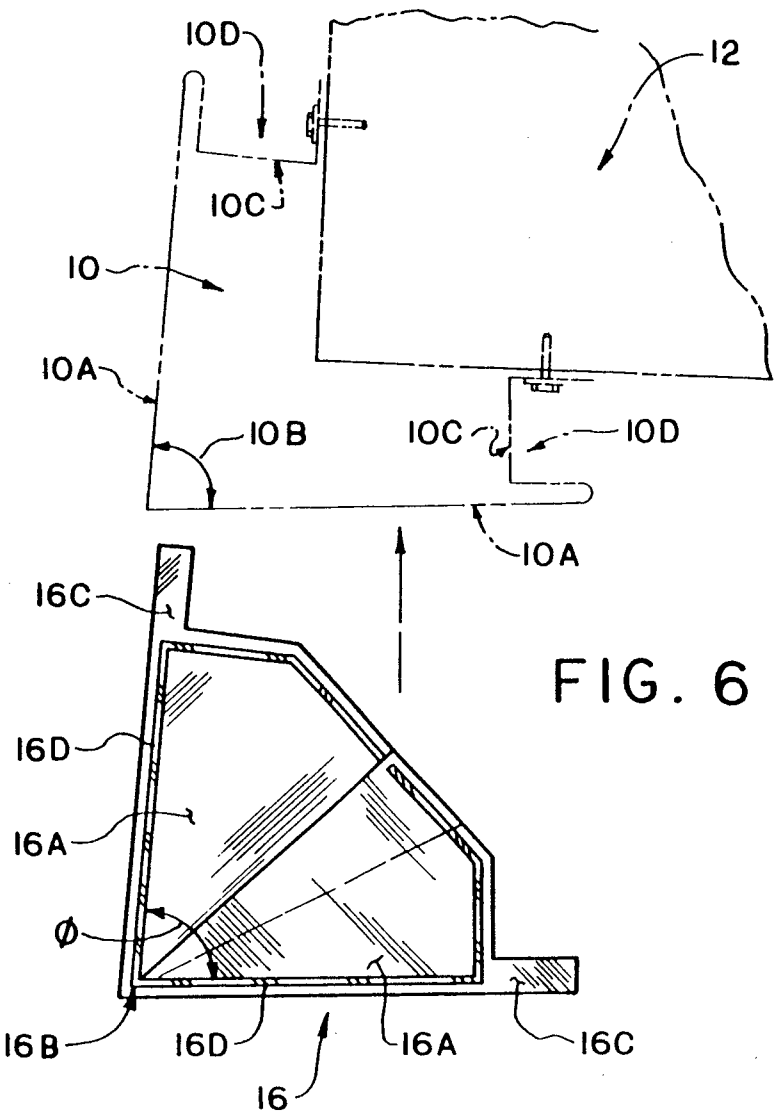
FIGS. 5 and 6 are schematic illustrations of a corner cap constructed according to the present invention, in the configuration of FIG. 1, and prior to attachment of the corner cap with the end of a corner post.
Figure 8:
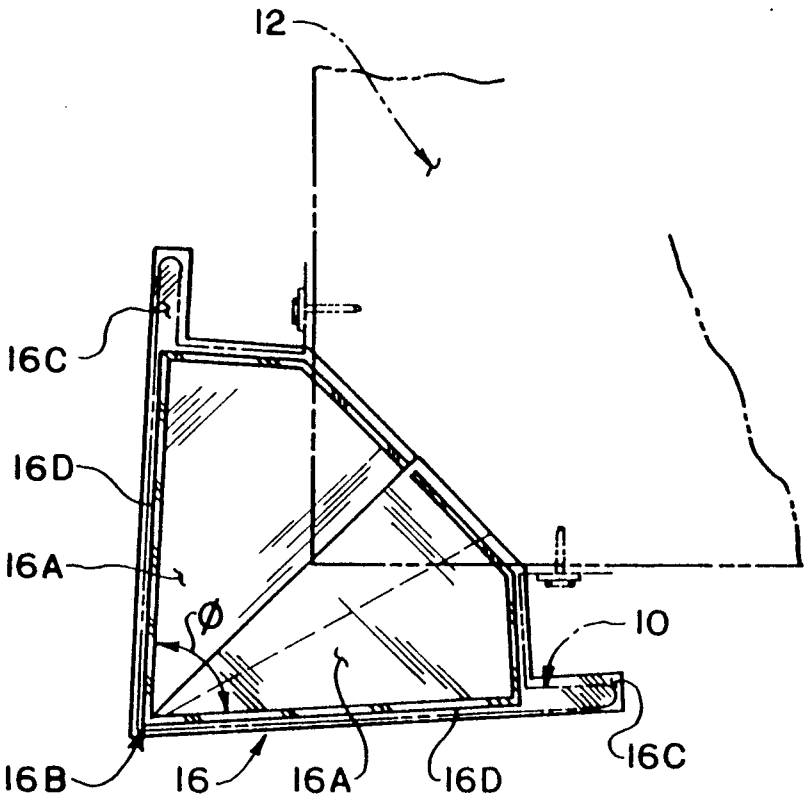
FIGS. 7 and 8 are schematic illustrations of the corner cap of FIGS. 5 and 6 after the corner cap has been attached with the corner post.

The corner cap 16 is then attached to the corner post 10. As illustrated in FIGS. 5–8, the short channel 18 formed by the wall portions 16D is inserted into the interior channel 10E in the corner post 10, until the base portions 16A engage the bottom of the corner post 10. The short channel 18 formed by the wall portions 16D will have a relatively close fit with the interior channel 10E of the corner post. That fit may provide some frictional engagement between the corner cap and the corner post to help hold the corner cap in engagement with the corner post. Further, as illustrated in FIGS. 5–8, the base portions 16A encompass a large enough area to completely cover the bottom of the corner post. Further, as illustrated in FIGS. 6 and 8, the integral fingers 16C on the base portions will cover the portion of the intermediate walls 10C of the corner post which form the exterior guides 10D for receiving the siding members. According to a preferred embodiment, adhesive is applied to selected portions of the corner cap and/or the corner post to securely attach the corner cap to the corner post.

Figure 10:
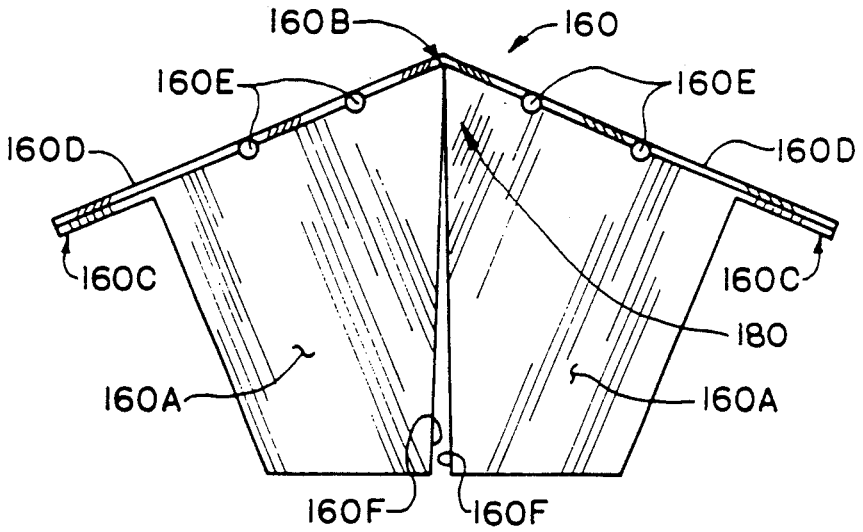
FIG. 10 is a top plan view of a modified version of a corner cap according to the present invention, and illustrating the components of the corner cap in one selected configuration.
Figure 11:
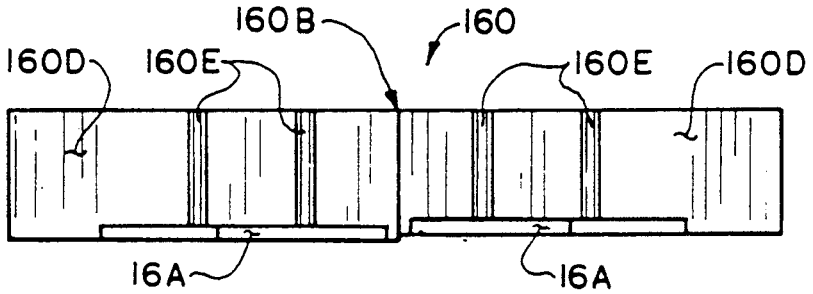
FIG. 11 is a front plan view of the corner cap of FIG. 10.
Figure 12:
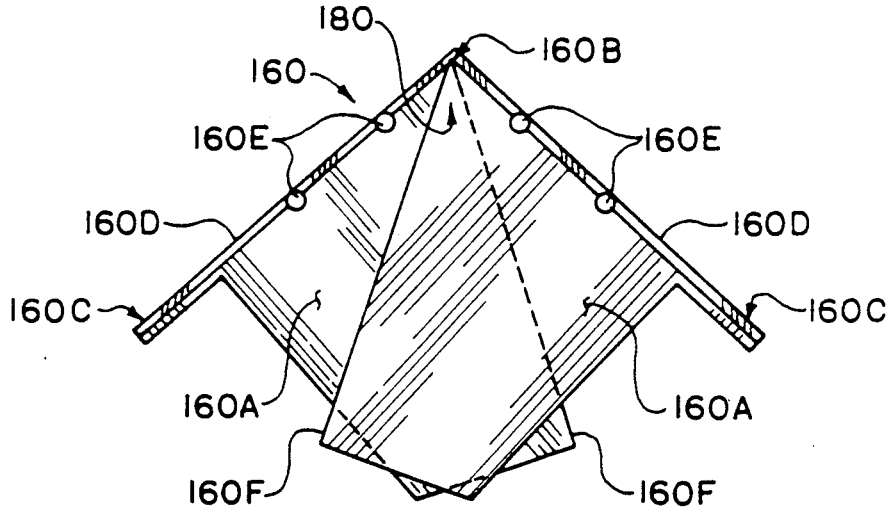
FIG. 12 is a top plan view of the modified corner cap of FIGS. 10, 11 and illustrating the components of the corner cap in another selected configuration.

A modified form of a corner cap according to the present invention is illustrated in FIGS. 10–12. The corner cap 160 comprises a pair of substantially planar base portions 160A, which are hinged together at a corner 160B which is integrally formed with the base portions. Each of the planar base portions 160A includes an integral distal finger portion 160C. Further, each of the planar base portions 160A has an integral wall portion 160D extending perpendicular to the plane of the base portion. Further, each wall portion 160D extends along the edge of the base portion which includes the distal finger portion 160C. Further, each of the wall portions 160D has a plurality of stiffening ribs 160E that are integral therewith and that extend normal to the plane of the base portion. (see FIGS. 10, 11). When the base portions 160A are in a selected configuration, the wall portions 160D define a short, V-shaped channel 180 (FIGS. 10, 12) extending perpendicularly to base portions 160A. Thus, when corner cap 160 is attached to the end of a corner post 10, the short, V-shaped channel 180 formed by the wall portions 160D should extend into and contact parts of the interior channel 10E of corner post 10 when the corner cap 160 is attached to the corner post, and should terminate just below the frame portion 12 of the building.

The planar base portions 160A are disposed in discrete, parallel planes (see FIG. 11), and are adapted to pivot about the corner 160B between two principal configurations. In one principal configuration, the base portions are not overlapped, but in plan view. Their edges 160F appear to be adjacent to each other (see FIG. 10) so that the planar base portions 160A form a substantially complete cover for a channel extending normal to their planes. In another principal configuration, the base portions are overlapped by preselected amount (see FIG. 12). As will be readily appreciated by those of ordinary skill in the art, the base portions 16A can be easily pivoted about the corner 160B to a selected overlapping configuration from a maximum value (i.e. when the base members are in the non-overlapping orientation of FIG. 10), to a minimum value (i.e. when the base members are overlapped by the amount illustrated in FIG. 12). Further, the base portions can be pivoted about the corner 160B into overlapped, intermediate configurations anywhere between the configurations of FIGS. 10 and 12 and form a substantially complete cover for a corner post. As can be readily seen from FIGS. 10 and 12, in the principal configurations, and in any of the intermediate configurations, the planar base portions 160A, when viewed in plan view, will form a substantially complete cover for the end of the corner post.

According to the modified version, the corner cap 160 is assembled with the corner post 10 by forming the corner cap 160, on site, into a configuration with a selected corner angle, and is then fixed in that configuration and attached to the corner post. For example, the corner cap of FIG. 12 schematically illustrates a configuration with a corner angle of approximately 85°. That is the smallest corner angle which a corner cap 160 according to the invention is designed to form. In that configuration, the base portions 160A are overlapped to their maximum extent and secured together, preferably by adhesive, to match the corner angle 10B of the corner post 10.

The corner cap 160 is then attached to the corner post 10. The short channel 180 formed by wall portions 160D is inserted into the interior channel 18E in the corner post 10, until the base portions 160A engage the bottom of the corner post 10. The short channel 180 formed by the wall portions 160D will have a relatively close fit with the interior channel 18E of the corner post. As illustrated in FIG. 11, the wall portions 160D extend along integral fingers 160C and are received in intermediate walls 10C of the corner post. That fit may provide additional frictional engagement and stability between the corner cap and the corner post to help hold the corner cap in engagement with the corner post. Further, the integral fingers 160C on the base portions will cover the portion of the intermediate walls 10C of the corner post which form the exterior guides 10D for receiving the siding members.

In the foregoing embodiment, adhesive can be applied to selected portions of the corner cap and/or the corner post in order to securely attach the corner cap to the corner post 10.

Thus, as seen from the foregoing discussion, the present invention provides an integrally formed single corner cap structure that can be selectively adjusted to a configuration which matches the corner angle of a corner post. The corner angle can be adjusted, on site, in order to form the corner cap into a selected configuration which accounts for changes in the corner angle of the corner post. Thus, a single corner cap structure according to the invention can be used, on site, to form a corner cap which can mate with different corner posts with different corner angle structures. With the foregoing concepts in mind, it is believed that various modifications of the concepts of the present invention will become further apparent to those of ordinary skill in the art.

We claim:

1. A corner cap for attachment to an end of a corner post of a building to cover the end of the corner post, the end of the corner post having a configuration determined by a corner angle of the corner post, said corner post defining a longitudinally extending channel the configuration of which is related to the configuration of the corner cap, said corner cap being adapted to be attached to the end of the corner post, said corner cap comprising sections which are movable relative to each other to adjust the configuration of the corner cap to form a substantially complete cover for the end of a corner post whose configuration is within a predetermined range, said corner cap sections defining a corner angle which is angularly adjustable as said sections move relative to each other to adjust the configuration of said corner cap, each of said sections defining a respective portion of a base for covering an end of the channel defined by the corner post, said portions of said base being substantially planar and angularly movable relative to each other over a predetermined angular range, said portions of the base varying over said predetermined angular range from an orientation in which said portions of the base are substantially co-planar to an orientation in which said portions of the base are overlapped to a predetermined extent, thereby to enable the corner cap to be formed into a substantially complete cover for the end of the channel of the corner post whose configuration is within the predetermined range.

2. A corner cap as defined in claim 1, wherein said sections of said corner cap are joined at an integral corner which forms a pivot axis for said sections, said pivot axis extending substantially transverse to the plane of said base portions when said base portions are in their substantially co-planar orientation, and said sections of said corner cap being pivotal about said pivot axis to enable said sections of said corner cap to move angularly relative to each other.

3. A corner cap as defined in claim 2, wherein each of said planar portions of said base has an integral wall portion extending transverse from the respective planar portion of said base, the wall portions cooperating to define a short channel which fits inside the end of a longitudinally extending channel of a corner post when the corner cap is attached to the corner post.

4. A corner cap as defined in claim 3, wherein said sections of said corner cap are joined at an integral corner which forms a pivot axis for said sections, said pivot axis extending substantially transverse to the plane of said base portions when said base portions are in their substantially co-planar orientation, and said sections of said corner cap being pivotal about said pivot axis to enable said sections of said corner cap to move angularly relative to each other.

5. A corner cap as defined in claim 4, wherein said base portions define a corner angle at said pivot axis, and wherein said pivot axis enables said planar base portions to be angularly adjusted relative to each other to define a corner angle which can vary from about 85° to about 135°.

6. A corner cap as defined in claim 2, wherein said portions of said base define a corner angle at said pivot axis, and wherein said pivot axis enables said planar portions of said base to be angularly adjusted relative to each other with a corner angle which can vary from about 85° to about 135°.

7. A method of covering an end of a corner post of a building, comprising the steps of forming a corner cap with a pair of sections that are integrally connected to each other and adjustable relative to each other to form a predetermined range of configurations of the corner cap, adjusting the sections of the corner cap relative to each other to form a selected configuration of the corner cap which is adapted substantially to cover the end of the corner post, securing the sections of the corner cap together to maintain the corner cap in said configuration, and attaching the corner cap to the end of the corner post to cover the end of the corner post.

8. A method as set forth in claim 7, wherein the corner cap sections define a corner angle which is angularly adjustable as said sections move relative to each other over said predetermined range to adjust the configuration of the corner cap, and wherein the step of adjusting the sections of the corner cap relative to each other comprises the step of moving the sections of the corner cap relative to each other to adjust the corner angle of the corner cap form said corner cap into said selected configuration.

9. A method as set forth in claim 8, wherein each of the sections of the corner cap comprises a substantially planar base portion, and the predetermined range is such that the relative orientations of the planar base portions can vary from a first orientation in which the planar base portions are substantially co-planar to a second orientation in which the planar base portions are overlapped to a predetermined extent, and wherein the step of moving the sections of the corner cap relative to each other comprises the step of adjusting the planar base portions between said first and second orientations to form said selected configuration.

10. A method as set forth in claim 9, wherein the corner post defines a channel, each planar base portion having an integral wall portion extending transverse from the respective planar base portion, said wall portions cooperating to define a short channel which can fit against the inside of the channel of a corner post when the corner cap is in said selected configuration and attached to the corner post, and wherein the step of attaching the corner cap to the corner post comprises the step of inserting the short channel of the corner cap into the end of the channel of the corner post.

11. A method as set forth in claim 10, wherein said planar base portions are integrally joined to each other at a corner angle, and wherein the step of moving the planar base portions comprises the steps of angularly moving the base portions relative to each other to vary the corner angle from about 85° to about 135°.

12. A method as set forth in claim 9, wherein said planar base portions are integrally joined to each other at a corner angle, and wherein the step of moving the planar base portions comprises the steps of angularly moving the base portions relative to each other to vary the corner angle from about 85° to about 135°.

13. A method as set forth in claim 8, wherein each of the sections of the corner cap comprises a substantially planar base portion, and the predetermined range is such that the relative orientation of the planar base portions can vary from a first orientation in which the planar portions are non-overlapping and are in discrete, parallel planes, to a second orientation in which the planar base portions are in said discrete, parallel planes and are overlapped to a predetermined extent, and wherein the step of moving the sections of the corner cap relative to each other comprises the step of adjusting the planar base portions between said first and second orientations to form said selected configuration.

14. A method as set forth in claim 13, wherein said planar base portions are integrally joined to each other at a corner angle, and wherein the step of moving the planar base portions comprises the steps of angularly moving the base portions relative to each other to vary the corner angle from about 85° to about 135°.

15. A corner cap for attachment to the end of a corner post of a building to cover the end of the corner post, the end of the corner post having a configuration determined by the corner angle of the corner post, said corner post defining a longitudinally extending channel the configuration of which is related to the configuration of the corner cap, said corner cap being adapted to be attached to the end of the corner post, said corner cap comprising sections which are movable relative to each other to adjust the configuration of the corner cap to form a substantially complete cover for the end of a corner post whose configuration is within a predetermined range, said corner cap sections defining a corner angle which is angularly adjustable as said sections move relative to each other to adjust the configuration of said corner cap, each of said sections defining a respective portion of a base for covering an end of a channel defined by a corner post, said portions of said base being substantially planar and angularly movable relative to each other over a predetermined angular range, thereby to enable the corner cap to be formed into a substantially complete cover for a channel of a end of the corner post whose configuration is within the predetermined range.

16. Corner cap as defined in claim 15, wherein each of the said planer portions of said base has an integral wall portion extending transverse from the respective planer portion of said base, the wall portions cooperating to define a short channel which fits inside the end of a longitudinally extending channel of a corner post when the corner cap is attached to the corner post.

17. A corner cap as defined in claim 16, wherein said sections of said corner cap are joined at an integral corner which forms a pivot axis for said sections, said pivot axis extending substantially transverse to the plane of said base portions when said base portions are in their non-overlapping orientation, and said sections of said corner cap being pivotal about said pivot axis to enable said sections of said corner cap to move angularly relative to each other.

18. A corner cap as defined in claim 17, wherein said base portions define a corner angle at said pivot axis, and wherein said pivot axis enables said planar base portions to be angularly adjusted relative to each other to define a corner angle which can vary from about 85° to about 135°.

19. A corner cap as defined in claim 15, wherein said sections of said corner cap are joined at an intergral corner which forms a pivot axis for said sections, said pivot axis extending substantially transverse to the discrete planes of said portions of said base, and said sections of said corner cap being pivotal about said pivot axis to enable said sections of said corner cap to move angularly relative to each other over said predetermined angular range.

20. A corner cap as defined in claim 19, wherein said base portions define a corner angle at said pivot axis, and wherein said pivot axis enables said base portions to be angularly adjusted relative to each other with a corner angle which can vary from about 85° to about 135°.

* * * * *

UNITED STATES PATENT AND TRADEMARK OFFICE

CERTIFICATE OF CORRECTION

PATENT NO. : 4,998,947

DATED : March 12, 1991

INVENTOR(S) : Gregory W. Dostall, et al.

It is certified that error appears in the above-identified patent and that said Letters Patent is hereby corrected as shown below:

Column 9, line 3, replace "form" with -- from --;

Column 9, line 59, replace "the" with -- an --;

Column 10, line 2, replace "the" with -- a --;

Column 10, line 20, before "end" replace "a" with -- an --;

Col. 10, line 23, change "Corner" to read --A corner--.

Column 10, line 25, replace "planer" with -- planar --.

Signed and Sealed this

Twenty-second Day of December, 1992

*Attest:*

DOUGLAS B. COMER

*Attesting Officer*

*Acting Commissioner of Patents and Trademarks*